US011197503B2

(12) United States Patent
Reevell

(10) Patent No.: US 11,197,503 B2
(45) Date of Patent: Dec. 14, 2021

(54) AEROSOL-GENERATING ARTICLE COMPRISING A PISTON AND AEROSOL-GENERATING DEVICE

(71) Applicant: PHILIP MORRIS PRODUCTS S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 324 days.

(21) Appl. No.: 16/302,178

(22) PCT Filed: May 24, 2017

(86) PCT No.: PCT/EP2017/062620
§ 371 (c)(1),
(2) Date: Nov. 16, 2018

(87) PCT Pub. No.: WO2017/202959
PCT Pub. Date: Nov. 30, 2017

(65) Prior Publication Data

US 2019/0274358 A1 Sep. 12, 2019

(30) Foreign Application Priority Data

May 25, 2016 (EP) ..... 16171404

(51) Int. Cl.
*A24F 40/40* (2020.01)
*A24F 40/46* (2020.01)
(Continued)

(52) U.S. Cl.
CPC ..... *A24F 40/46* (2020.01); *A24D 1/20* (2020.01); *A24F 7/00* (2013.01); *A24F 40/20* (2020.01)

(58) Field of Classification Search
CPC ..... A24F 40/40; A24F 40/42; A24F 42/60; A24F 47/008
See application file for complete search history.

(56) References Cited

U.S. PATENT DOCUMENTS 5,240,012 A 8/1993 Ehrman
5,726,421 A 3/1998 Fleischhauer
(Continued)

FOREIGN PATENT DOCUMENTS

CN 2257649 7/1997
CN 103859605 6/2014
(Continued)

OTHER PUBLICATIONS

Office Action and Search Report issued in Russia for Application No. 2018145530 dated Sep. 25, 2020 (14 pages). English translation included.

(Continued)

*Primary Examiner* — Cynthia Szewczyk
(74) *Attorney, Agent, or Firm* — Mueting Raasch Group

(57) ABSTRACT

The aerosol-generating article comprises a housing having an open end. The housing comprises a cavity for holding an aerosol-forming substrate. The article further comprises a piston movable within the housing into the direction of the open end of the housing. The aerosol-generating device comprises a cavity for receiving at least a portion of an aerosol-generating article comprising an aerosol-forming substrate. A heating chamber is arranged adjacent the cavity for heating aerosol-forming substrate received from the aerosol-generating article. The cavity and the heating chamber are arranged along a same longitudinal axis such that aerosol-forming substrate is transferrable from the aerosol-generating article into the heating chamber with a linear movement in the direction of the longitudinal axis.

20 Claims, 4 Drawing Sheets

(51) Int. Cl.

| | |
|---|---|
| ***A24F 7/00*** | (2006.01) |
| ***A24D 1/20*** | (2020.01) |
| *A24F 40/20* | (2020.01) |

(56) References Cited

U.S. PATENT DOCUMENTS

| | | | |
|---|---|---|---|
| 2009/0293892 | A1 | 12/2009 | Williams et al. |
| 2012/0325227 | A1 | 12/2012 | Robinson |
| 2013/0152922 | A1 | 6/2013 | Benassayag |
| 2013/0199528 | A1 | 8/2013 | Goodman |
| 2013/0312742 | A1 | 11/2013 | Monees |
| 2014/0283855 | A1 | 9/2014 | Hawes |

FOREIGN PATENT DOCUMENTS

| | | |
|---|---|---|
| CN | 203723440 | 7/2014 |
| CN | 104188107 | 12/2014 |
| DE | 3227982 | 2/1984 |
| EA | 000244 | 2/1999 |
| EP | 0822760 | 6/2003 |
| EP | 2944205 | 11/2015 |
| GB | 2524856 | 10/2015 |
| KR | 20120006994 | 10/2012 |
| WO | WO 96/39879 | 12/1996 |
| WO | WO 2012/164033 | 12/2012 |
| WO | WO 2015/086318 | 6/2015 |
| WO | WO 2015/165814 | 11/2015 |

OTHER PUBLICATIONS

PCT Search Report and Written Opinion for PCT/EP2017/062620 dated Dec. 4, 2017 (18 pages).
Office Action issued in China for Application No. 201780031884.9 dated Dec. 7, 2020 (19 pages). English translation included.

AEROSOL-GENERATING ARTICLE COMPRISING A PISTON AND AEROSOL-GENERATING DEVICE

This application is a U.S. National Stage Application of International Application No. PCT/EP2017/062620 filed May 24, 2017, which was published in English on Nov. 30, 2017, as International Publication No. WO 2017/202959 A2. International Application No. PCT/EP2017/062620 claims priority to European Application No. 16171404.3 filed May 25, 2016.

The invention relates to aerosol-generating devices and aerosol-generating articles for use in such devices.

Aerosol-generating systems are known, where aerosol-forming substrate is introduced into a heating chamber of a device. Therein, aerosol-forming substrate is heated and substances are evaporated from the substrate, which substances may form an inhalable aerosol. The aerosol-forming substrate may be provided in loose form or may be provided in small pots. Substrate in loose form provides the advantage that the 'pure' substrate is present in the heating chamber and amount and mixture of the substrate may be chosen by a user. However, regulating the quantity of loose substrate will depend on the experience of a user but will always lead to an inconsistent user experience. For a clean application and consistent user experience, a predefined amount of an aerosol-forming substrate may be provided in a pot, which pot is inserted into the heating chamber. In these applications, the material of the pot is also heated and the pot may restrict escape of evaporated substances.

Therefore, it would be desirable to have an aerosol-generating article and an aerosol-generating device with advantages of prior art solutions but without their limitations. In particular, it would be desirable to have an aerosol-generating article and an aerosol-generating device that provide the advantage of conveniently injecting a consistent quantity of aerosol-forming substrate into a heating chamber, providing a consistent user experience.

According to the invention there is provided an aerosol-generating article comprising a housing having an open end. The housing comprises a cavity for holding an aerosol-forming substrate, which can be a tobacco consumable. The aerosol-generating article further comprises a piston movable within the housing into the direction of the open end of the housing. By pushing the piston into the direction of the open end of the housing of the article, aerosol-forming substrate that may be contained in the cavity may be pushed through the open end of the housing and out of the article. The article is preferably configured for use with an aerosol-generating device, in particular with an aerosol-generating device according to the invention and as described herein.

The cavity in the housing may be defined by a base of the piston forming one end of the cavity, inner housing walls and the open end of the housing forming the opposite end of the cavity.

The article may comprise a predefined amount of aerosol-forming substrate, advantageously defined by the size of the cavity. Before filling aerosol-forming substrate into a cavity, the amount of aerosol-forming substrate may be measured and may thus provide a consistent user experience each time a same aerosol-forming article is used in a specific aerosol-generating device. In addition, aerosol-forming substrate in the cavity is mechanically protected by the housing until its immediate use. Preferably, the substrate is also protected from other environmental influences, such as for example humidity or oxidation. This may, for example, be realized by the provision of a protecting foil in or by which the article may be sealed; or the cavity comprising the aerosol-forming substrate may be sealed, for example by sealing the open end of the housing. Such a protecting foil or sealing may be removed before use of the article.

The piston arranged in the housing facilitates moving the aerosol-forming substrate out of the cavity and out of the housing. This may be achieved by a short linear movement of the piston, for example, over the length of the cavity.

Preferably, the aerosol-forming substrate such as a tobacco consumable is directly pushed into a heating chamber of an aerosol-generating device configured to receive the substrate. In this manner, a well-defined amount of aerosol-forming substrate may be supplied to a heating chamber in preparation for using the device, offering a consistent user experience. A simple design of an aerosol-generating device is supported as will be outlined in more detail below.

The aerosol-generating article may, for example, be realized by a housing and a piston being two coaxially arranged cylinders or piston and housing of other geometrical forms. In such embodiments, preferably the housing is a hollow cylinder and the piston is a solid cylinder.

Preferably, housing and piston form a close fit such that no aerosol-forming substrate may pass between piston and housing. A cavity in the housing may be formed beneath the base of the piston. However, an airflow passage may be provided between piston and housing for air or aerosol containing air to pass through the passage.

Depending on the arrangement and sizes of piston and housing, a piston may be arranged entirely inside a housing or may protrude from the housing.

A piston may be arranged flush with an end of a housing, preferably before use or after use of the article, that is before or after pushing aerosol-forming substrate out of the cavity. The piston arranged flush with an end of the housing may, for example, be used as operation control, to indicate a status of the article or substrate, such as the position of the aerosol-forming substrate. A piston arranged flush with one end of the housing may simplify stacking of the articles for storing and may indicate that the substrate is still present in the article or that the substrate has completely been pushed out of the housing. A protruding piston is easily accessible for pushing the substrate out of the housing.

Preferably, a length of the housing is identical to or longer than a length of the piston. The piston may be arranged at one extreme end of its moving range when the aerosol-forming substrate is stored in the cavity of the article. The piston may be at its other extreme end of its moving range when the aerosol-forming substrate is entirely pushed out of the cavity.

The aerosol-generating article may comprise at least one airflow channel through the article. Preferably, the airflow channel extends from one end of the article to an opposite end of the article. Such an airflow channel may allow evaporated substances from the aerosol-forming substrate to pass from a heating chamber through the article and further downstream in the device, for example into or through a mouthpiece. Such an airflow channel may also allow fresh air to pass through the article and into a heating chamber to pick up evaporated substrates generated in the heating chamber.

The aerosol-generating article may comprise a plurality of airflow channels through the article.

An airflow channel may for example extend from the open end of the housing to the opposite end of the housing, from one end of the piston to the opposite end of piston, from the open end of the housing to the proximal end of the piston depending on sizes and relative arrangement of piston and housing.

The at least one airflow channel may, for example, be arranged along the piston. The channel may be arranged within the piston, for example forming a centrally arranged channel. The channel or channels may also be arranged between the piston and the housing, for example in an outer piston wall or an inner housing wall. A plurality of channels may be arranged symmetrically and regularly in the article.

An airflow channel in the article may, for example, also be provided by selecting manufacturing tolerances between piston and inner housing walls in order to provide an airflow channel of desired size.

Preferably, the aerosol-generating article comprises an aerosol-forming substrate provided in the cavity. Preferably, the cavity is filled with aerosol-forming substrate. The aerosol-forming substrate in the article may be flush with the open end of the housing.

The aerosol-generating article may comprise a predefined amount of an aerosol-forming substrate being one fill of a heating chamber of an aerosol-generating article. Preferably, the one fill provides one user experience. In particular, the aerosol-generating article may be a filling cartridge comprising a predefined amount of an aerosol-forming substrate. Preferably, the predefined amount of the aerosol-forming substrate is to be filled into the heating chamber of the aerosol-generating device in one transfer movement of the piston prior to using the aerosol-generating device or starting a user experience.

The aerosol-forming substrate may be transferrable en bloc or as a whole from the aerosol-generating article into the heating chamber, in particular by one transfer movement of the piston. Preferably, the aerosol-generating article and the aerosol-generating device are configured such as to transfer and receive the aerosol-forming substrate in a shape-retaining or dimensionally stable manner, that is, such that the aerosol-forming substrate is transferrable from the aerosol-generating article into the heating chamber substantially without deformation. The material forming the housing and the piston may be the same or may be different. The material forming the housing and the piston may be any material capable to withstand elevated temperatures as present in an aerosol-generating device, for example operating temperatures of such devices. The material forming the housing and the piston may be polymeric, for example a polymer capable of withstanding temperatures of about 150 degree Celsius. Suitable materials for the article may include: paper or card, silicone rubber, cellulose acetate, ceramic or glass, or high temperature polymers such as PEEK or polyamide. Optionally, for cost reduction, a portion of the article in contact with the heater or heating chamber may be heat resistant and the part not in contact with the heater or heating chamber may be cheaper non-heat resistant plastic material.

Preferably, the aerosol-forming substrate is a substrate capable of releasing volatile compounds that can form an aerosol. The volatile compounds are released by heating the aerosol-forming substrate.

The aerosol-forming substrate is a non-liquid, in particular solid aerosol-forming substrate. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

The aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco.

Optionally, the aerosol-forming substrate may contain additional tobacco or non-tobacco volatile flavour compounds, to be released upon heating of the aerosol-forming substrate. The solid aerosol-forming substrate may also contain capsules that, for example, include the additional tobacco or non-tobacco volatile flavour compounds and such capsules may melt during heating of the solid aerosol-forming substrate bulk.

The aerosol-forming substrate may comprise other additives and ingredients, such as nicotine or flavourants.

The aerosol-forming substrate preferably comprises nicotine and at least one aerosol former.

The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerol and water to take advantage of the triacetin's ability to convey active components and the humectant properties of the glycerol.

Aerosol formers may be selected from the polyols, glycol ethers, polyol ester, esters, and fatty acids and may comprise one or more of the following compounds: glycerol, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

The aerosol-forming substrate may comprise one or more sheets of homogenised tobacco material that has been gathered to fit into the cavity of the article. The aerosol-forming substrate may comprise a crimped and gathered sheet of homogenised tobacco material.

Preferably, the tobacco sheet is a cast leaf. Cast leaf is a form of reconstituted tobacco that is formed from a slurry including tobacco particles, fiber particles, aerosol former, binder and for example also flavours.

A sheet of aerosol-forming substrate may, for example, also be cut into strips and subsequently inserted into the cavity and fixed in their position, for example by a form fit of the substrate and the article housing or a binding agent.

Aerosol-forming substrate may also be a paste-like material, a sachet of porous material comprising aerosol-forming substrate, or, for example, loose tobacco mixed with a gelling agent or sticky agent, which could include a common aerosol former such as glycerine, and then compressed or molded into a plug. When this is deployed, compressed and heated in the heating chamber, the plug may remain substantially as a single piece.

According to the invention there is also provided an aerosol-generating device comprising a cavity for receiving at least a portion of an aerosol-generating article comprising an aerosol-forming substrate, in particular a non-liquid, preferably solid aerosol-forming substrate. The aerosol-generating device further comprises a heating chamber arranged adjacent the cavity for heating aerosol-forming substrate received from the aerosol-generating article. The cavity and the heating chamber are arranged along a same longitudinal axis such that aerosol-forming substrate is transferrable from the aerosol-generating article into the heating chamber with a linear movement in the direction of the longitudinal axis.

Preferably, the aerosol-generating device is configured for use with an aerosol-generating article according to the invention and as described herein. In particular, the cavity of the device is adapted for receiving at least a portion of an aerosol-generating article according to the invention and as described herein.

The device may be of simple construction. The cavity for receiving the aerosol-generating article or at least of a portion thereof as well as the heating chamber may both be constructed as cavities. If the cavity for receiving the aerosol-forming article and a cavity forming the inside of the heating chamber are substantially formed by one large cavity, then the cavity for receiving the article is preferably provided with a stop to position the article in the large cavity such as to not reach into the heating chamber. Heating chamber walls and article housing may, for example, be arranged adjacent each other.

The heating chamber comprises a heating element for heating a content of the heating chamber. The heating element may be arranged outside or inside the heating chamber. The heating chamber walls itself may contain or be the heating element.

Preferably, heat is provided to the substrate in a heating chamber through resistive or inductive heating. The heating chamber may be heated resistively or inductively.

The coaxial alignment of cavity and heating chamber permits insertion and removal of the aerosol-forming substrate with a simple linear movement with the piston. An aerosol-forming substrate may be transferred from the article to the heating chamber by a short translational movement.

In particular, the device may be configured such that the aerosol-forming substrate is transferrable en bloc or as a whole from the aerosol-generating article into the heating chamber, in particular by one linear movement in the direction of the longitudinal axis. Preferably, the aerosol-generating device is configured such as to enable a shape-retaining transfer of the aerosol-forming substrate from the aerosol-generating article into the heating chamber, that is, such that the aerosol-forming substrate is transferrable from the aerosol-generating article into the heating chamber substantially without deformation.

Preferably, an inner diameter or inner lateral dimension, in particular an inner lateral clearance dimension of the heating chamber substantially corresponds to or is only slightly larger than the outer diameter or outer lateral dimension of aerosol-forming substrate transferred from an article. For example, a heating chamber may have a same or an about 10 percent larger diameter or outer lateral dimension than the outer diameter or outer lateral dimension of the aerosol-forming substrate to be heated in the chamber. Accordingly, an inner lateral dimension, in particular an inner lateral clearance dimension of the housing of the aerosol-generating article preferably corresponds to an inner lateral dimension, in particular an inner lateral clearance dimension of the heating chamber.

Preferably, a size of the heating chamber substantially corresponds to or is only slightly larger than the size of aerosol-forming substrate to be heated.

For example, a volume of a heating chamber is the same or may be about 10 percent larger than the volume of the aerosol-forming substrate to be heated in the chamber. Preferably, a size of a cavity in an article corresponds to a size of a heating chamber.

Preferably, the device provides access to a piston of an article when the article is arranged in the cavity of the device. The piston may be pushed directly by a user or via an element of the device. The device itself may provide the possibility for pushing the piston with a push element. The aerosol-generating device may comprise a push element adapted for pushing a piston of an aerosol-generating article relative to a housing of the aerosol-generating article.

The aerosol-generating device may comprise a device housing and a mouthpiece, wherein the mouthpiece may comprise the push element. In such embodiments, the piston may be pushed directly upon assembly of the mouthpiece and the device housing. The piston may be pushed separately, for example, by separately activating the push element.

The aerosol-generating device may comprise an ejection mechanism for ejecting aerosol-forming substrate out of the heating chamber. The ejection mechanism may be adapted to eject an aerosol-forming article out of the device or at least partly out of the device. The article may then be gripped and discarded by a user.

The heating chamber of a device comprises a base and heating chamber walls. The base may be relatively movable to the heating chamber walls. Upon moving the base into the direction of the top of the heating chamber, a content of the heating chamber is ejected from the heating chamber.

Relatively moving the base may, for example, be performed by activation of a lever connected to the base.

A movable base may also serve for cleaning the heating chamber. Upon ejecting a content of the heating chamber the circumference of the base may clean the heating chamber walls and thus reduce the amount of residues left in the heating chamber after use of the device. This provides a simple and efficient cleaning procedure not requiring elaborate cleaning mechanisms for the heating chamber.

Ejecting aerosol-forming substrate out of the heating chamber may be performed by pushing the used substrate back into the article. It may also be performed by pushing the article at least partially out of its cavity in the device housing. The partly pushed out article may then be gripped and disposed of or be refilled. If the article is arranged loosely in a device housing, the article may be removed from the housing, for example, by gravitational force: By turning the device upside down and possibly tapping at or shaking the device. Such a movement may also be used for removal of any remaining aerosol-forming substrate left in the device.

For ejecting the article out of the device, entirely or at least partly, a further or separate ejection mechanism may be provided. For example, a separate lever, preferably operable from an exterior of the aerosol-generating device may be provided in the device.

A base having been moved to the top of the heating chamber may be pushed back into its original position as base of the heating chamber for renewed filling of the heating chamber. Such backward movement of the base may be performed, for example, by moving a lever connected to the base of the heating chamber. The base may also be brought into its original position by the insertion of new aerosol-forming substrate. The substrate pushes against the base of the heating chamber upon pushing the substrate out of an article. Thereby the base is moved to the bottom of the heating chamber.

According to the invention there is further provided an aerosol-generating system comprising an aerosol-generating device according to the invention and as described herein and an aerosol-generating article according to the invention and as described herein. The aerosol-generating article is arranged at least partially in the cavity of the device.

In the aerosol-generating system an inner lateral dimension, in particular an inner lateral clearance dimension of the housing of the aerosol-generating article preferably corresponds to an inner lateral dimension, in particular an inner lateral clearance dimension of the heating chamber of the device. This supports a simple set-up of the system and operation of the system.

Advantages and further elements of the system have been described relating to the aerosol-generating device according to the invention and the aerosol-generating article according to the invention.

According to the invention there is also provided a method for use of an aerosol-generating device. The method comprises the step of providing an aerosol-generating device according to the invention and as described herein. The method further comprises the step of providing an aerosol-forming substrate within a cavity of a housing having an open end and a piston movable within the housing and the step of pushing the piston into the direction of the open end of the housing, thereby pushing the aerosol-forming substrate through the open end out of the housing and into the heating chamber of the device. The piston may thereby close the open end of the housing with a base or a distal end of the piston.

The method may further comprise the steps of providing the heating chamber with a movable base and moving the base of the heating chamber into the direction of the top of the heating chamber, thereby ejecting used aerosol-forming substrate out of the heating chamber.

Advantages of the method according to the invention have been described relating to the device, the article and the system according to the invention and will not be repeated.

According to the invention there is also provided a kit for an aerosol-generating system. The kit comprises an aerosol-generating device comprising a cavity for receiving at least a portion of an aerosol-generating article comprising an aerosol-forming substrate. The device further comprises a heating chamber arranged adjacent the cavity for heating aerosol-forming substrate received from the aerosol-generating article. The kit further comprises an aerosol-generating article comprising a housing having an open end. The housing comprises a cavity for holding aerosol-forming substrate. Accordingly, the article may comprise an aerosol-forming substrate, in particular a non-liquid, preferably solid aerosol-forming substrate, provided in the cavity. The article further comprises a piston movable within the housing into the direction of the open end of the housing. The aerosol-generating article is configured to be mounted at least partly in the cavity of the aerosol-generating device such that the aerosol-forming substrate is transferrable from the aerosol-generating article into the heating chamber with a linear movement.

In particular, the aerosol-forming substrate may be transferrable en bloc or as a whole from the aerosol-generating article into the heating chamber, in particular by one transfer movement of the piston. Preferably, the aerosol-generating article and the aerosol-generating device are configured such as to transfer and receive the aerosol-forming substrate in a shape-retaining or dimensionally stable manner, that is, such that the aerosol-forming substrate is transferrable from the aerosol-generating article into the heating chamber substantially without deformation.

In the device comprised in the kit, the heating chamber may comprise a movable base, which is configured to be movable into the direction of the top of the heating chamber such that used aerosol-forming substrate is ejectable out of the heating chamber.

Preferably, the aerosol-generating device is a device according to the invention and as described herein.

Preferably, the aerosol-generating article is an article according to the invention and as described herein. Further features and advantages of the kit according to the invention have been described relating to the device, the article and the system according to the invention and will not be repeated.

The invention will be further described, by way of example only, with reference to the accompanying drawings, in which.

Figure 1:
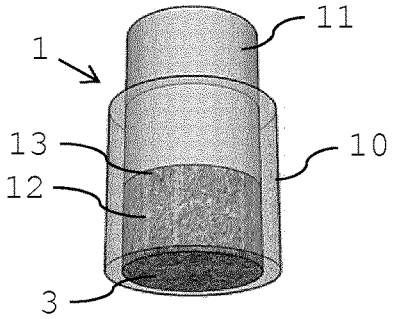
FIGS. 1, 2 are illustrations of an embodiment of an aerosol-generating article with aerosol-forming substrate in the article (FIG. 1) and pushed-out (FIG. 2) of the article.
Figure 2:
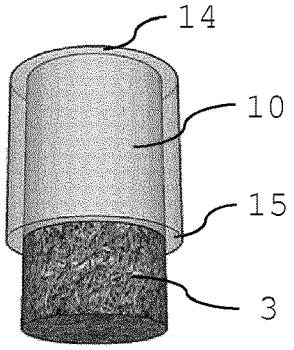

FIG. 1 shows an aerosol-generating article 1 comprising a housing 10 in the form of a hollow cylinder. The housing 10 is drawn in a semi-transparent manner to best illustrate the elements arranged inside the housing. A piston 11 in the form of a cylinder is partially, about halfway, arranged in the hollow cylinder housing. Piston 11 and housing 10 have a same length and the piston protrudes from the housing. Below the base 13 of the piston a cavity 12 is formed within the housing 10. The cavity 12 is filled with an aerosol-forming substrate 3, for example a tobacco substrate. In use, for example, after the article 1 has been inserted into an aerosol-generating device, the piston 11 is pushed into the housing 10, thereby pushing the aerosol-forming substrate 3 out of the cavity 12 and out of the open base end 15 of the housing 10 and thereby out of the article 1. This pushed-out state is illustrated in FIG. 2, wherein the piston 11 is arranged flush with the top end 14 of the housing 10 indicating a complete emptying of the cavity 12.

Figure 3:
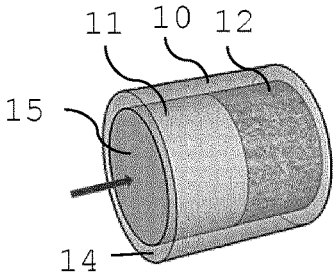
FIGS. 3, 4 are illustrations of another embodiment of an aerosol-generating article with aerosol-forming substrate in the article (FIG. 3) and pushed-out (FIG. 4) of the article.
Figure 4:
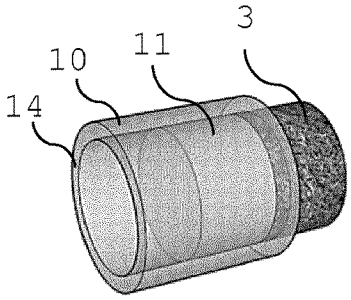

FIG. 3 and FIG. 4 show a hollow cylinder housing 10 and cylindrical piston 11, wherein the piston 11 has about half the length of the housing 10. Again, the housing 10 is drawn in a semi-transparent manner. The piston 11 is entirely arranged in the housing 10 with a top 15 of the piston 11 being arranged flush with the top end 14 of the housing 10. Below the base of the piston a cavity 12 is formed, which is filled with aerosol-forming substrate 3. In use, the piston 11 is pushed further into the housing (indicated by an arrow in FIG. 3), thereby pushing the substrate out of the cavity 12. The pushed-out state is shown in FIG. 4.

An end stop (not shown) may be provided in the housing 10 to prevent the piston 11 from being partly or entirely pushed out of the housing 10 together with the substrate 3. An end stop may also be provided to prevent or hinder a movement of the piston in an opposite direction that is to prevent or hinder the piston 11 to return to its original position as shown in FIG. 3.

Figure 5:
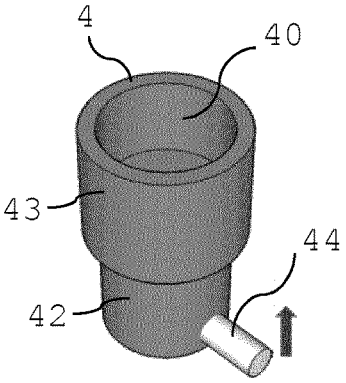
FIGS. 5, 6 show a heater assembly.
Figure 6:
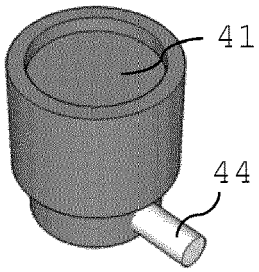

FIG. 5 and FIG. 6 show a heater 4 having a cylindrical heating chamber 40 and a movable base 41. The movable base is formed by the top of a cylindrical heating chamber piston 42, which is movable within a hollow cylinder, which forms the heating chamber walls 43. The heating chamber piston 42 is provided with a lever 44 protruding radially outwardly from the piston 42. By activating the lever 44 the heating chamber piston 42 may be moved into the heating chamber (moving direction indicated by an arrow in FIG. 5) thereby moving the base 41 of the heater versus the top of the heater. Thereby, aerosol-forming substrate may be ejected from the heating chamber 40, for example after the substrate has been used. The base 41 may be moved to its original position again, for example by activating the lever 44 in opposite direction or by pushing the base backwards (downwards in FIG. 6). A pushing movement may, for example, be realized by aerosol-forming substrate being pushed into the heater 4.

Figure 7:
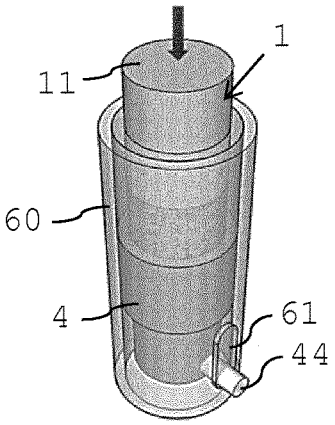
FIGS. 7-9 show views of a portion of an aerosol-generating device comprising a heater assembly and an aerosol-generating article.
Figure 8:
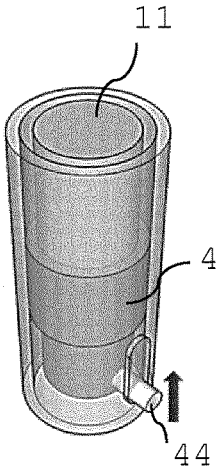
Figure 9:
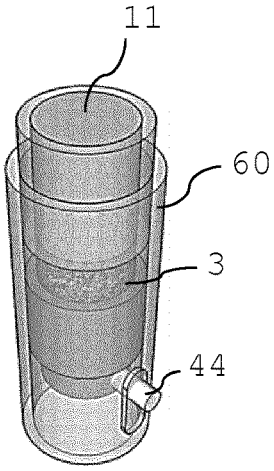

FIGS. 7 to 9 show the article 1 of FIGS. 1 and 2 and the heater 4 of FIGS. 5 and 6 arranged in a device housing 60 of an aerosol-generating device. Device housing 60, as well as article housing 10 are drawn in a semi-transparent manner to best illustrate the elements arranged inside the device housing 60.

The device housing 60 has basically the form of a hollow cylinder and the article 1 and heater 4 are arranged next to each other inside along the device housing 60. The top of the heater 4 formed by the rim of the heating chamber walls 43 forms an end stop for the inserted article 1. FIG. 7 shows the article having been inserted into a cavity in the device housing 60 above the heater 4, the cavity being provided for receiving the aerosol-forming article 1. The piston 11 of the article 1 is then pushed further into the device housing 60 thereby being pushed into the article housing 10 and pushing the aerosol-forming substrate 3 out of the base end 15 of the article directly into the heating chamber of the heater 4 as is illustrated in FIG. 8. Preferably, outer and inner diameter of the article housing and of the heater or heating chamber, respectively, correspond to each other such that the aerosol-forming substrate may be entirely transferred from the article into the heating chamber 40 of the heater 4 with a short, linear movement of the piston 11 along a longitudinal axis of the device.

The device housing 60 comprises a longitudinal opening 61 in the housing wall where the lever 44 of the heater 4 laterally protrudes from the housing 60. After the substrate has been used or for preparing the device for a reloading, the lever 44 of the heater 4 may be pushed upwards in the opening 61 (indicated by an arrow). The base 41 of the heater is pushed upward, pushing the used substrate out of the heating chamber and into the direction of the article. The substrate may be pushed back into the article or as shown in FIG. 9, the substrate 3 pushes the article at least partially out of the device housing 60. The article may now be gripped and disposed of or be refilled.

Piston 11 and housing 10 may be provided with a locking mechanism to limit the movement of the piston to the desired range. For example, a locking mechanism may prevent the piston from being entirely pushed out of the housing.

The size of the opening 61 may define end stops for the movement of the base 41 of the heater 4 in opposite directions (upward and downward in FIGS. 7-9). In order to remove all used substrate from the device, the device may for example be turned upside down such that the substrate is removed from the device by gravitational force.

Figure 10:
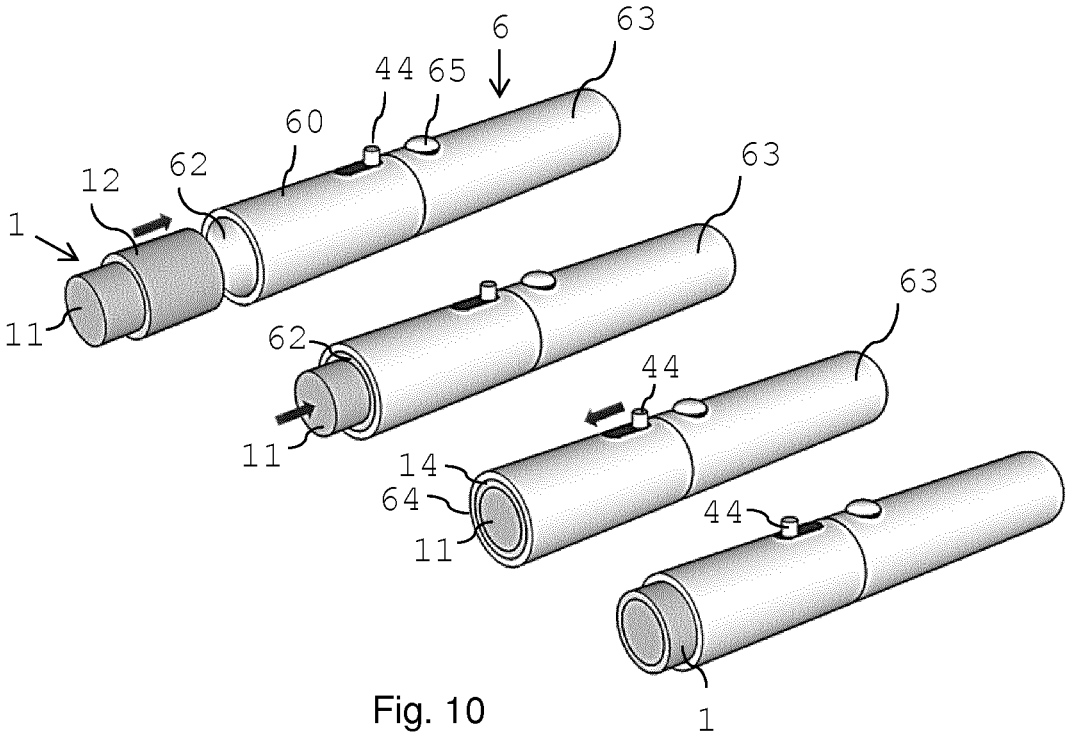
FIG. 10 shows use of an embodiment of an aerosol-generating device.
Figure 11:
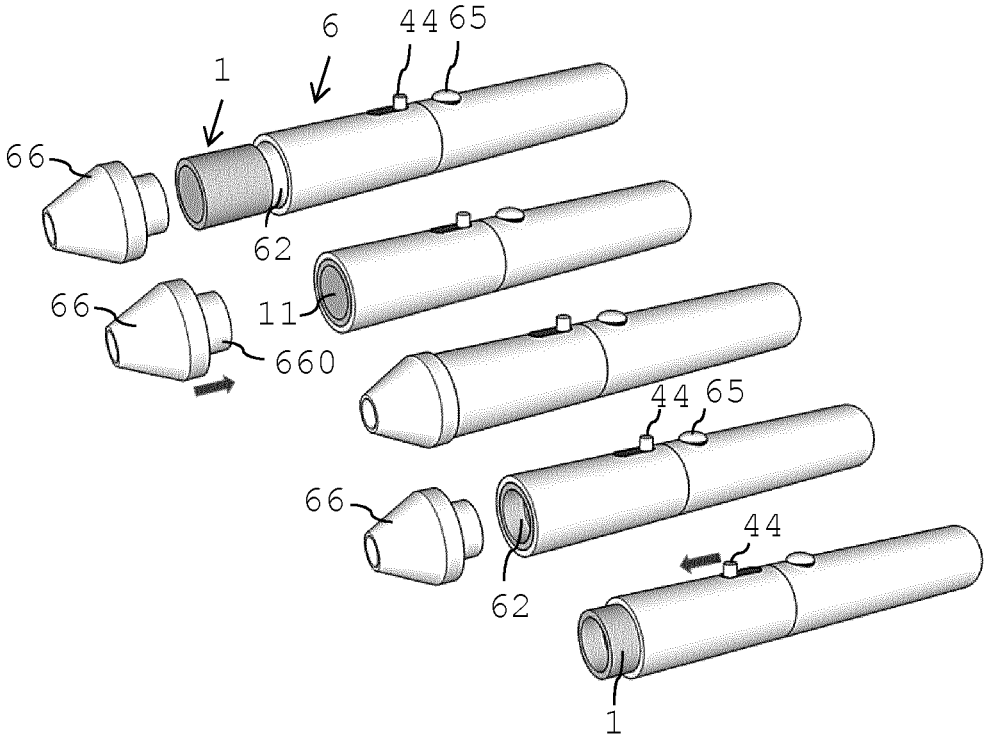
FIG. 11 shows use of another embodiment of an aerosol-generating device.

FIG. 10 and FIG. 11 show variants of aerosol-generating devices 6 adapted for use of different embodiments of aerosol-generating articles. Devices and articles are generally rod-shaped having a substantially circular cross section.

In FIG. 10 the device housing 60 is provided with a cylindrical cavity 62 for receiving the aerosol-generating article 1 having a piston 11 protruding from the article housing 12. The article 1 is inserted into the cavity 62 to an extent such that the piston protrudes from the proximal end of the housing 60. The device housing 60 comprises a heater (not shown), for example one as described in FIGS. 5 and 6.

A distal portion of the device housing 63 may, for example, comprise a power source such as a battery and electronics for controlling a heating of the device. The distal portion of the device is provided with an activation knob 65 for activating the device, for example starting a heating cycle. Before activation of the device, the protruding piston 11 of the article is pushed into the article housing such that piston 11, upper end of article housing 14 and proximal end of the device 64 are flush with each other. By this movement of the piston, the substrate is inserted into a heating chamber and the device is ready for heating the substrate.

After use, the lever 44 of the heater 4 may be moved into the direction of the proximal end of the device. The article is partially pushed out of the proximal end of the device 6 such that the article 1 may be gripped by a user and completely be removed from the device.

In FIG. 10 the piston 11 of the article is pushed into the article housing, for example directly by a user's finger or for example by means of a mouthpiece as shown in FIG. 11. Preferably, mouthpieces or other push elements are used for aerosol-generating articles having counter-sunk pistons.

In FIG. 11 the aerosol-generating article 1 comprises a counter-sunk piston 11, which is pushed into the device by a push element 660 provided at the mouthpiece 66. After insertion of the article 1 into the cavity 62 of the device housing 60, mouthpiece 66 and device housing 60 may be assembled. Upon assembly, the push element 660 of the mouthpiece 66 pushes the piston 11 further into the article housing and thus the substrate into the heating chamber. In FIG. 11, the diameter of the push element 666 corresponds to the diameter of the piston. The push element may also have a smaller diameter than the piston. Preferably, the length of the push element corresponds to the length of the cavity in the article filled with aerosol-forming substrate. By entirely inserting the push element 660 into the article housing, the aerosol-forming substrate is entirely pushed out of the cavity 62 and into the heater.

An activation of the lever 44 ejects the article 1 again partially out of the cavity 62 also disassembling the mouthpiece 66 from the device housing 60.

Figure 12:
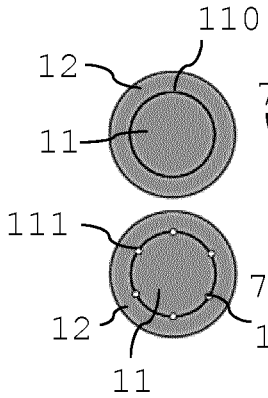
FIG. 12 shows cross sections through aerosol-generating articles.

FIG. 12 shows top views onto aerosol-generating articles having coaxially arranged piston 11 and housing 12. An airflow from the heating chamber through the article 1 to a proximal end of the device is shown in FIG. 13 in the longitudinal cross sectional view through the device.

The airflow is provided along the interface between piston 11 and housing 12. In the cross section of the article in the top drawing of FIG. 12, the diameters of piston 11 and housing 12 are chosen to provide a thin circumferentially running passage 110 between piston and housing, allowing an airflow, comprising or not comprising aerosol, to pass through the passage 110. In the article in the bottom drawing of FIG. 12, the interface is provided with a plurality of regularly arranged distinct longitudinal channels 111.

Figure 13:
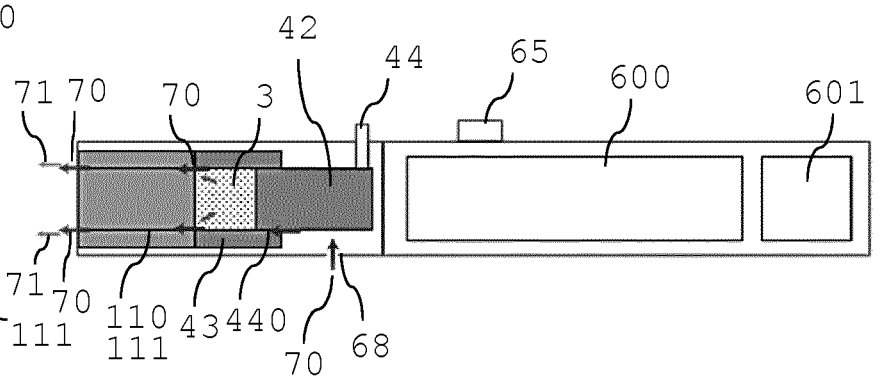
FIG. 13 shows an air-flow management through an aerosol-generating device.

FIG. 13 schematically shows an aerosol-generating device and a variant of flow management. Again same reference numbers are used for the same or similar elements.

The device housing 60 is provided with an inlet opening 68 in a housing wall, for example slightly upstream of the position of the heating chamber, allowing air 70 from the environment to enter the device. The air 70 passes between heating chamber piston 42 and heating chamber walls 43 from the base of the heater into the heating chamber and through the heated aerosol-forming substrate 3 arranged in the heating chamber. There aerosol or evaporated substances 71 are picked up by the airflow and the aerosol containing airflow 70, 71 passes through the passage 110 or the channels 111 of the article 1 and out of the proximal end of the device. This proximal end may be provided with a mouthpiece.

Figure 14:
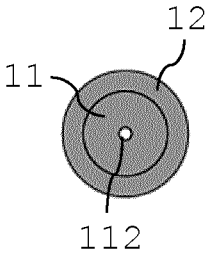
FIG. 14 shows another cross section through an aerosol-generating article.
Figure 15:
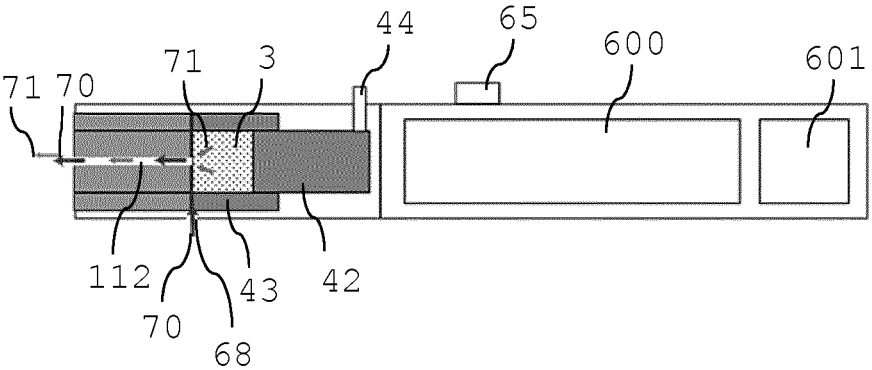
FIG. 15 shows another air-flow management through an aerosol-generating device.

FIG. 14 and FIG. 15 illustrate an airflow management, where aerosol-containing air passes centrally through the aerosol-generating article.

The piston 11 of the article is provided with a centrally arranged channel 112.

In the device of FIG. 15 air 70 enters the device housing through an opening 68 in the housing wall. The opening 68 is arranged next to the top of the heater. The air 70 enters the heating chamber between distal end of the article 1 and the heating chamber. The airflow carries evaporated substances through the channel 112 in the center of the article 1 and out of the device.

Figure 16:
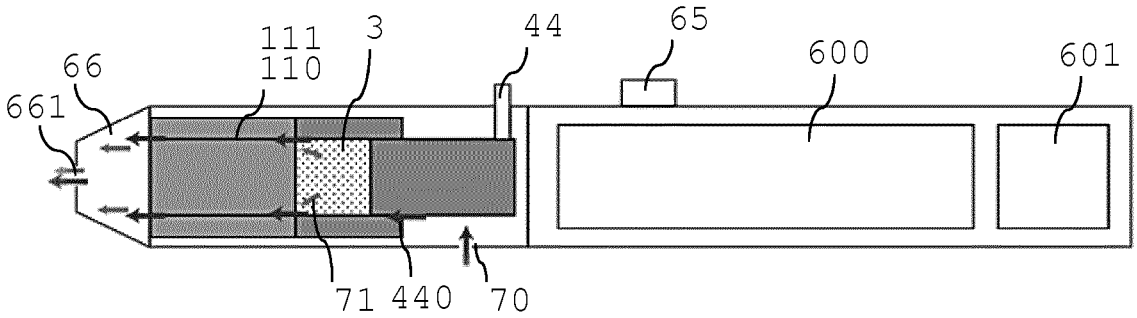
FIGS. 16-18 show further air-flow managements through aerosol-generating devices.
Figure 17:
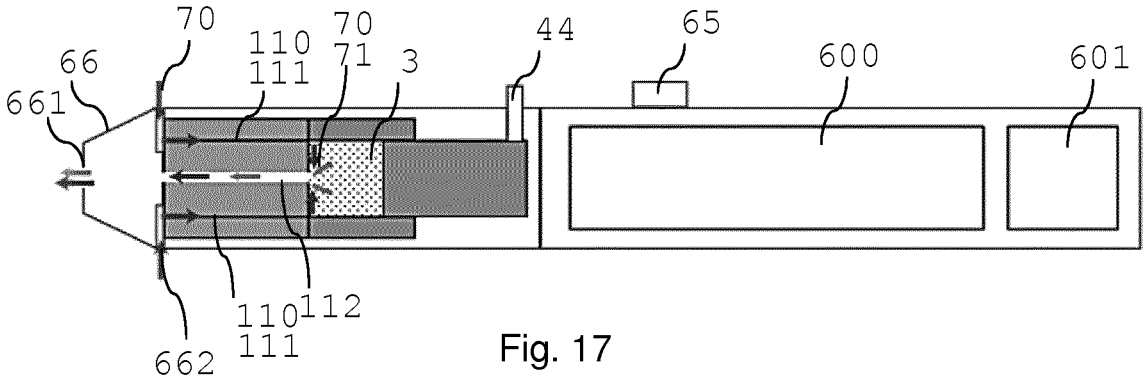
Figure 18:
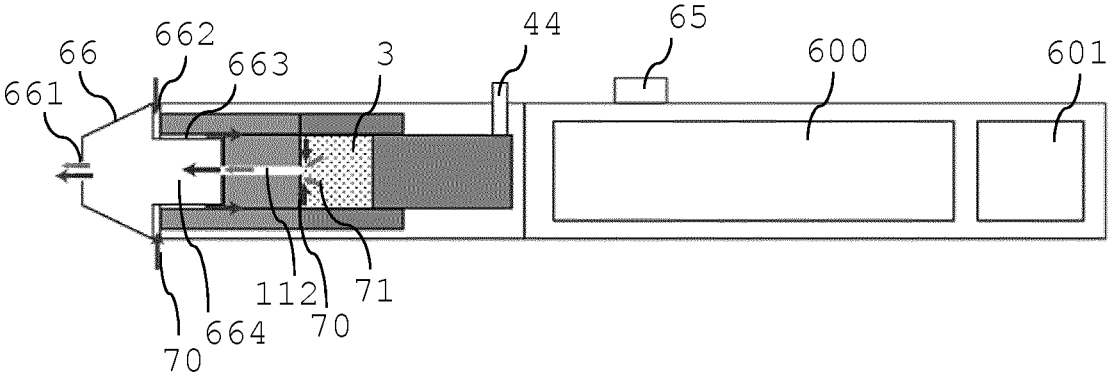

FIGS. 16 to 18 illustrate aerosol-generating devices comprising a mouthpiece 66. The mouthpiece 66 comprises a centrally arranged outlet opening 661, where aerosol-containing air 70, 71 may leave the mouthpiece and may be inhaled by a user. The device of FIG. 16 corresponds to the device of FIG. 13, where aerosol containing air is passing downstream along the circularly arranged interface of the article and is collected in the mouthpiece 66. Preferably, the mouthpiece 66 is hollow. The mouthpiece may be provided with directing and mixing elements supporting a mixing of air and aerosol. The distal portion of the device housing comprises a power source such as a battery 600 and electronics 601 for controlling a heating of the device.

In FIG. 17 one or several inlet openings 662 are provided between mouthpiece 66 and proximal end of the device housing 60. The air 70 radially inwardly entering the device through said inlet openings 662 passes through channels 111 or passage 110 through the article into the heating chamber and the aerosol-forming substrate 3 arranged in the heating chamber. The airflow charged with aerosol 71 leaves the device through a centrally arranged channel 112 in the article and the outlet opening 661 in the mouthpiece.

FIG. 18 illustrates a similar airflow management as shown in FIG. 17, however, with an article having a piston with a length smaller than that of the article housing 12. In use, the piston 11 is pushed into the direction of the heating chamber with an extension 664 of the mouthpiece 66 serving as push element. Between extension 664 and article housing 12 a small channel is formed through which air 70 entering between mouthpiece 66 and proximal end of the device housing 60 may pass to the interface between piston and housing. The air 70 continuous through channels 111 or a passage 110 through the article into the heating chamber and the aerosol-forming substrate 3 arranged in the heating chamber. The airflow charged with aerosol 71 leaves the article in a downstream direction through a centrally arranged channel 112 in the article and via the extension 664 into the mouthpiece 66. The mouthpiece may be hollow and the aerosol-containing air may leave the mouthpiece via outlet opening 661.

Embodiments of articles and devices as well as airflow management have been shown by way of examples only. Different combinations and variations are also possible without departing from the scope of the invention, for example variations and combinations relating to an airflow into and through a heating chamber or into and through an aerosol-generating article, relating to devices including or excluding mouthpieces or to arrangement and design of push elements.

The invention claimed is:

1. Aerosol-generating article for use with an aerosol-generating device, comprising an article-receiving cavity configured to receive at least a portion of the aerosol-generating article and a heating chamber arranged adjacent the article-receiving cavity for heating aerosol-forming substrate received from the aerosol-generating article, the article comprising a housing having an open end, the housing comprising a substrate-holding cavity for holding an aerosol-forming substrate, wherein a solid aerosol-forming substrate is provided in the substrate-holding cavity, the article further comprising a piston movable within the housing into the direction of the open end of the housing.

2. Aerosol-generating article according to claim 1, wherein a length of the housing is identical to or longer than a length of the piston.

3. Aerosol-generating article according to claim 1, further comprising at least one airflow channel through the article, the airflow channel extending from one end of the article to an opposite end of the article.

4. Aerosol-generating article according to claim 3, wherein the at least one airflow channel is arranged along the piston.

5. Aerosol-generating system comprising an aerosol-generating device and an aerosol-generating article according to claim 4, wherein the article-receiving cavity and the heating chamber are arranged along a same longitudinal axis such that aerosol-forming substrate is transferrable from the aerosol-generating article into the heating chamber with a linear movement in the direction of the longitudinal axis, wherein the aerosol-generating article is arranged at least partially in the article-receiving cavity of the device.

6. Aerosol-generating system comprising an aerosol-generating device and an aerosol-generating article according to claim 3, wherein the article-receiving cavity and the heating chamber are arranged along a same longitudinal axis such that aerosol-forming substrate is transferrable from the aerosol-generating article into the heating chamber with a linear movement in the direction of the longitudinal axis, wherein the aerosol-generating article is arranged at least partially in the article-receiving cavity of the device.

7. Aerosol-generating system according to claim 6, wherein the device comprises a push element adapted for pushing the piston of the aerosol-generating article relative to the housing of the aerosol-generating article.

8. Aerosol-generating system according to claim 6, wherein the device comprises a device housing and a mouthpiece, the mouthpiece comprising the push element.

9. Aerosol-generating system comprising an aerosol-generating device, and an aerosol-generating article according to claim 1 wherein the article-receiving cavity and the heating chamber are arranged along a same longitudinal axis such that aerosol-forming substrate is transferrable from the aerosol-generating article into the heating chamber with a linear movement in the direction of the longitudinal axis, wherein the aerosol-generating article is arranged at least partially in the article-receiving cavity of the device.

10. Aerosol-generating system according to claim 9, wherein the device further comprises an ejection mechanism for ejecting aerosol-forming substrate out of the heating chamber.

11. Aerosol-generating system according to claim 10, wherein the device comprises a push element adapted for pushing the piston of the aerosol-generating article relative to the housing of the aerosol-generating article.

12. Aerosol-generating system according to claim 9, wherein the device comprises a push element adapted for pushing the piston of the aerosol-generating article relative to the housing of the aerosol-generating article.

13. Aerosol-generating system according to claim 12, wherein the device comprises a device housing and a mouthpiece, the mouthpiece comprising the push element.

14. Aerosol-generating system according to claim 9, wherein the heating chamber comprises a base and heating chamber walls, which base is relatively movable to heating chamber walls.

15. Aerosol-generating system according to claim 9, wherein an inner lateral dimension of the housing of the aerosol-generating article corresponds to an inner lateral dimension of the heating chamber.

16. Kit for an aerosol-generating system, the kit comprising an aerosol-generating device and an aerosol-generating article comprising an aerosol-forming substrate, the aerosol-generating device comprising an article-receiving cavity configured to receive at least a portion of the aerosol-generating article comprising an aerosol-forming substrate, the device further comprising a heating chamber arranged adjacent the article-receiving cavity for heating aerosol-forming substrate received from the aerosol-generating article, the aerosol-generating article comprising a housing having an open end, the housing comprising a substrate-holding cavity for holding aerosol-forming substrate, wherein a solid aerosol-forming substrate is provided in the substrate-holding cavity, the article further comprising a piston movable within the housing into the direction of the open end of the housing;

wherein the aerosol-generating article is configured to be mounted at least partly in the article-receiving cavity of the aerosol-generating device such that the aerosol-forming substrate is transferrable from the aerosol-generating article into the heating chamber with a linear movement.

17. Kit according to claim 16, wherein the device further comprises an ejection mechanism for ejecting aerosol-forming substrate out of the heating chamber.

18. Kit according to claim 16, wherein the heating chamber comprises a movable base, which is configured to be movable into the direction of the top of the heating chamber such that used aerosol-forming substrate is ejectable out of the heating chamber.

19. Kit according to claim 16, wherein the device comprises a push element adapted for pushing the piston of the aerosol-generating article relative to the housing of the aerosol-generating article.

20. Kit according to claim 19, wherein the device comprises a device housing and a mouthpiece, the mouthpiece comprising the push element.

* * * * *